US009512742B2

(12) United States Patent
Christgen et al.

(10) Patent No.: US 9,512,742 B2
(45) Date of Patent: Dec. 6, 2016

(54) METHOD FOR MOUNTING A VALVE TRAIN OF AN INTERNAL COMBUSTION ENGINE

(71) Applicant: Schaeffler Technologies AG & Co. KG, Herzogenaurach (DE)

(72) Inventors: Wolfgang Christgen, Seukendorf (DE); Volker Schmidt, Burgernheim (DE); Michael Schober, Vestenbergsgreuth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/777,655

(22) PCT Filed: Feb. 4, 2014

(86) PCT No.: PCT/DE2014/200040
§ 371 (c)(1),
(2) Date: Sep. 16, 2015

(87) PCT Pub. No.: WO2014/154211
PCT Pub. Date: Oct. 2, 2014

(65) Prior Publication Data

US 2016/0102583 A1 Apr. 14, 2016

(30) Foreign Application Priority Data

Mar. 28, 2013 (DE) ..... 10 2013 205 533

(51) Int. Cl.
*F01L 1/04* (2006.01)
*F01L 1/047* (2006.01)
*F01L 1/18* (2006.01)

(52) U.S. Cl.
CPC ..... *F01L 1/047* (2013.01); *F01L 1/185* (2013.01); *F01L 2103/00* (2013.01); *F01L 2105/00* (2013.01)

(58) Field of Classification Search
CPC ..... F01L 1/047; F01L 1/185; F01L 2105/00; F01L 2103/00
(Continued)

(56) References Cited

U.S. PATENT DOCUMENTS 6,003,482 A 12/1999 Kampichler
7,314,027 B2 * 1/2008 Murata ..... F01L 13/0063 123/90.16
(Continued)

FOREIGN PATENT DOCUMENTS

DE 19631653 2/1998
DE 19845942 4/2000
DE 102011120011 6/2012

OTHER PUBLICATIONS

Groh, W., "The Technical Drawing", 10th, heavily revised edition, 266 Figures, 110 Table, VEB Verlag, Technik Berlin, 1980, pp. 8, 124, 152, 156, 168.
(Continued)

*Primary Examiner* — Zelalem Eshete
(74) *Attorney, Agent, or Firm* — Volpe and Koenig, P.C.

(57) ABSTRACT

A method for mounting a valve train (1) of an internal combustion engine, having, parallel to a row of cam followers (2), a camshaft (13) which has a cam (15) per cam follower (2), which cam (15) acts on the roller (10) of said cam follower (2), which camshaft (13) is supported with respect to the cylinder head (3) via an axial bearing (14), wherein a) the cam followers (2) are provided presorted into two main groups (A, B); b) the two mounts (11) of each cam follower (2) of the first main group (A) run with offset in relation to the longitudinal extent of the cam follower (2) in the side surfaces (12) with respect to one another in such a way that an axial line of the pin (9) differs in the clockwise direction from perpendicular; c) the offset of the second main group (B) differs in the counterclockwise direction
(Continued)

from perpendicular, and d) a partial quantity of the first and second main group (A, B) are selected and mounted for each row of cam followers (2) in order to minimize/compensate for an axial thrust of the camshaft (13).

7 Claims, 1 Drawing Sheet

(58) Field of Classification Search
USPC ..... 123/90.6
See application file for complete search history.

(56) References Cited

U.S. PATENT DOCUMENTS

| | | | |
|---|---|---|---|
| 2001/0015188 | A1 | 8/2001 | Tanaka et al. |
| 2007/0227485 | A1 | 10/2007 | Tores et al. |
| 2010/0050974 | A1 | 3/2010 | Lester et al. |

OTHER PUBLICATIONS

Rempke, V, et al., "Mechanical Components and Assemblies", Knowledge Repository for Industrial Training, 2nd heavily revised edition, 1981, VEB Verlag Technik Berlin, pp. 149-151.

* cited by examiner

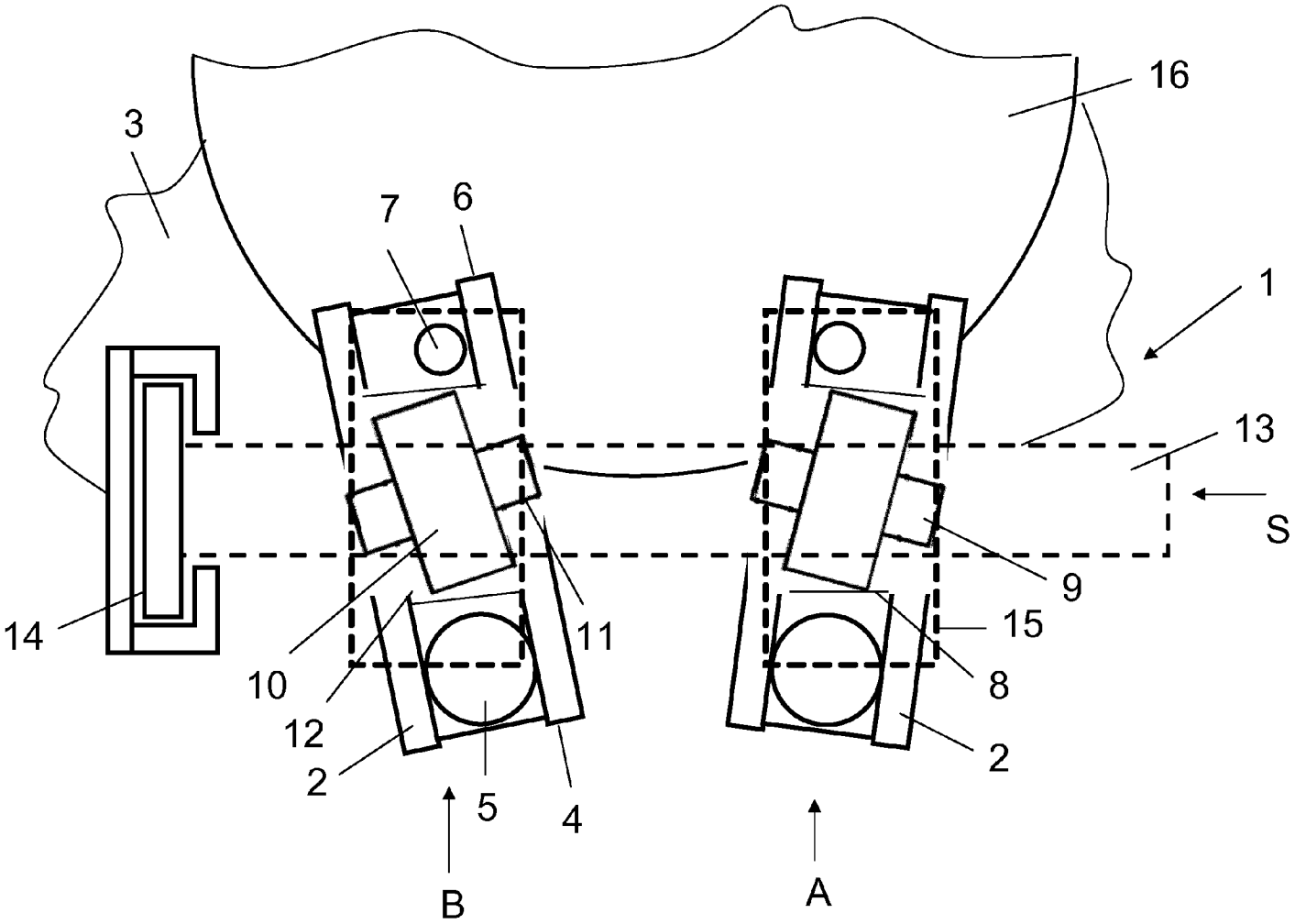
1
13
S
16
9
15
8
2
A
11
4
6
5
7
B
12
2
10
3
14

METHOD FOR MOUNTING A VALVE TRAIN OF AN INTERNAL COMBUSTION ENGINE

BACKGROUND

The invention relates to a method for mounting a valve train of an internal combustion engine and to a valve train of an internal combustion engine, wherein this valve train is provided with at least one row of cam followers of which each is supported on one side on a bottom side on an end by means of a pivot support relative to a cylinder head of the internal combustion engine and acts on the other end on at least one gas exchange valve and, on the other side, has at least in the middle section a cut-out in which a roller running on a pin sits, wherein this pin is supported in mounts of side surfaces of the cut-out, wherein a camshaft runs parallel to the row of cam followers, wherein this camshaft has, for each cam follower, a cam or a sliding cam package acting on its roller and this camshaft is supported by means of an axial bearing relative to the cylinder head of the internal combustion engine.

A valve train according to the class is known from the technical book "Valve train systems for internal combustion engines," (2003) Verlag Moderne Industrie, ISBN 3-478-93293-9, p. 25. Shown are an intake and exhaust row of cam followers that are supported so that they can pivot on hydraulic support elements. For each cylinder of the internal combustion engine there are two identically acting gas exchange valves (4-valve technology). Each gas exchange valve is loaded by a cam follower. A camshaft with a cam for each cam follower is arranged above a row of cam followers. The run-on of the corresponding cam on the cam follower is realized by a roller that sits on a pin mounted in mounts of side walls of the cam follower.

Due to tolerances that cannot be avoided in the production of the mounts for the respective pins in the side walls of the corresponding cam follower, the roller supported on top, seen in top view of the cam follower, has an offset with respect to the longitudinal extent of the cam follower and thus an offset with respect to the opposing cam. The roller consequently deviates, stated simply, from the desired perpendicular orientation. The deviations vary in both the clockwise and counterclockwise directions (+/−) and ultimately cannot be avoided without extreme costs in terms of production and quality assurance.

For the use of a row of cam followers in the internal combustion engine, in the worst case, a predominant number of mounts can have an offset in only one direction. During operation, due to the addition of the transverse forces (axial thrust) caused by the contact on the camshaft, this tolerance situation can lead to an axial displacement of the camshaft such that its axial bearing contacts one end due to the application of this transverse force. This causes increased friction, wear, and noises in this area.

SUMMARY

The objective of the invention is to provide a mounting method for the valve train specified above and a valve train in which the axial thrust mentioned above is minimized with low costs.

According to the invention, this objective is achieved by the method with one or more features of the invention, according to which a) The cam followers are provided pre-sorted into two main groups, b) The two mounts of each cam follower of the first main group run relative to each other with offset with respect to the longitudinal extent of the cam follower in the side surfaces such that an axial line of the pin deviated from the perpendicular in the clockwise direction, c) the two mounts of each cam follower of the second main group run relative to each other with offset with respect to the longitudinal extent of the cam follower in the side surfaces such that an axial line of the pin deviates from the perpendicular in the counterclockwise direction, and d) for each row of cam followers, a sub-group from the first and second main groups is selected and mounted for minimizing/compensating for an axial thrust of the camshaft on the axial bearing.

In this way, a valve train is provided without the disadvantages specified above. In particular, the axial displacement of the camshaft (axial thrust) occurring under the most unfavorable conditions is significantly reduced or even excluded by the summation of the transverse forces, so that there is no longer increased friction or unnecessarily high wear in its axial bearing.

It is especially preferred if the cam followers in each main group are provided pre-sorted into sub-groups. In other words, each main group (positive offset/negative offset) provides sub-groups in which the cam followers are further finely grouped with respect to their offset. Here, two or better more than two sub-groups are provided.

The pre-sorted cam followers can also be provided for better differentiation with simple markings, such as notches, weld points, rings, color points, embossments, laser marks, etc.

The internal combustion engine in which the valve train mounted according to the invention or the valve train according to the invention can be used can be, for example, but not exclusively, a quality-regulated or quantity-regulated, 4-cylinder 4-stroke internal combustion engine with two identically acting gas exchange valves per cylinder. Conceivable and planned for are, however, also internal combustion engines with a number of cylinders and gas exchange valves deviating upward or downward from that specified here. The decisive feature is that the previously mentioned axial thrust onto the axial bearing of the camshaft is ultimately at least minimized by the select use of cam followers of the two main groups above the corresponding row.

The axial bearing of the camshaft can be provided as a sliding bearing. However, it is also provided to use an axial rolling bearing for supporting the axial thrust forces on both sides of the camshaft-fixed bearing ring.

According to one preferred improvement of the invention, the use of the mounts of each cam follower can be produced selectively. According to a similarly preferred alternative, the cam followers can also be produced "unselected" under the guarantee of a "reasonable" production tolerance for the positional deviation of the mounts, wherein through a measurement and sorting process, the two main groups are then formed with the especially preferred respective sub-groups of cam followers.

For the first measure, the later measurement and sorting expenses are eliminated. For the second solution, production equipment used to date can be used without tool changes. However, subsequent measurement and sorting processes must still be performed and it can happen, but does not have to, that under some circumstances those followers in which the mount offset is approximately at 0 are separated out.

However, it would also be possible in this context to use a row of cam followers with a mount offset close to or equal to 0.

In another implementation of the invention it is proposed to use a hydraulic or mechanical support element with a ball head as the pivot support for the at least one cam follower.

For the dependent device it is to be noted that this also relates to valve trains with the cam followers from two main groups or from two main groups with the corresponding sub-groups that are used in internal combustion engines with a number of cylinders or valves per cylinder that ≠4.

A select offset of the entire cam follower with respect to the camshaft with or without select offset of its mounts for minimizing the axial thrust is also possible.

The protection of the invention also relates to rocker arms or finger levers so that "cam follower" is also to be understood as "rocker arm" or "finger lever."

BRIEF DESCRIPTION OF THE DRAWINGS

The invention will be explained with reference to the drawing. Shown are:

The sole FIGURE shows schematically a valve train in top view with components of the internal combustion engine.

DETAILED DESCRIPTION OF THE PREFERRED EMBODIMENTS

A valve train 1 installed in a cylinder head 3 of an internal combustion engine is shown. This valve train has a row of cam followers 2, wherein here exactly two cam followers 2 per cylinder 16 of the internal combustion engine are shown.

Each cam follower 2 is supported on a bottom side on one end 4 by a pivot support 5 formed as a support element relative to the cylinder head 3. On the other end 6, the cam follower 2 acts on a gas exchange valve 7. The two gas exchange valves 7 of the cylinder 16 have identical actions.

In a middle section, each cam follower 2 has a cut-out 8. In this cut-out there is a rolling or sliding supported roller 10 on a pin 9. The pin 9 is mounted in mounts 11 of side surfaces 12 of the cut-out 8.

In parallel to the row of cam followers 2 there is a camshaft 13 indicated by a dash-dash line. For each cam follower 2, this has a cam 15 that acts on its roller 10 and is also shown by a dash-dash line. The camshaft 13 is supported by means of an axial bearing 14 installed here on the end relative to the cylinder head 3 of the internal combustion engine, wherein a representation of the radial bearing for the camshaft 13 has been eliminated for the sake of simplicity.

To prevent the axial thrust described above on the camshaft 13, which, in the worst case, can lead to an undesirably high loading of the axial bearing 14, the cam followers 2 are provided pre-sorted into two main groups A, B and mounted accordingly. Here it is clear that each main group A, B has sub-groups $A_1, A_2, \ldots ; B_1, B_2, \ldots$ of cam followers that are provided finely grouped with respect to their offset.

Accordingly, the two mounts 11 of each cam follower 2 of the first main group A [right half of the FIGURE] are produced relative to each other with offset with respect to the longitudinal extent of the cam follower 2 in the side surfaces 12 such that an axial line of the pin 9 deviates from the perpendicular in the clockwise direction.

Simultaneously, the two mounts 11 of each cam follower 2 of the second main group B [left half of the FIGURE] are produced relative to each other with offset with respect to the longitudinal extent of the cam follower 2 in the side surfaces 12 such that an axial line of the pin 9 deviates from the perpendicular in the counterclockwise direction. According to the FIGURE, this thus produces a V-position of the cam followers 2 relative to each other. Here it is clear that, depending on the view, an A-position of the cam followers 2 relative to each other is also possible.

Thus, for each cylinder 16 of the internal combustion engine, two cam followers 2 are mounted with pins 9 ultimately limited relative to each other in opposite directions with rollers 10. The magnitude of the limitation/offset can be equal. Thus, as shown, a limitation of the cam followers 2 themselves with respect to the camshaft 13 is prevented, during which limitation the cam followers 2 are rotated past their "pivot support 5" rotational point so that they contact the gas exchange valve 7 in the section of their other "free" end 6 with a maximum lateral deflection. However, the intelligent combination of cam followers 2 of the main groups A, B significantly minimizes the axial thrust acting on the camshaft 13 and ultimately its axial bearing 14 from the "inclined" cam-roller contact.

For forming cam followers 2 of the main groups A, B with their respective sub-groups ($A_1, A_2, \ldots ; B_1, B_2, \ldots$), their mounts 11 can be produced either selectively with offset or it is provided, after the production of a completely identical batch of cam followers 2, to then measure the offset +/− of the mounts 11 varying within the tolerance limits and then to form from this the members of the main groups A, B.

LIST OF REFERENCE NUMBERS AND SYMBOLS

1) Valve train
2) Cam follower
3) Cylinder head
4) One end
5) Pivot support
6) Other end
7) Gas exchange valve
8) Cut-out
9) Pin
10) Roller
11) Mount
12) Side surface
13) Camshaft
14) Axial bearing
15) Cam
16) Cylinder
A) First main group of cam followers
B) Second main group of cam followers

The invention claimed is:

1. A method for mounting a valve train of an internal combustion engine that is provided with at least one row of cam followers of which each is supported on a bottom side on one end by a pivot support relative to a cylinder head of the internal combustion engine and acts on at least one gas exchange valve on the other end and has, on the other side, at least in a middle section, a cut-out in which a roller that runs on a pin sits, wherein said pin is supported in mounts of side surfaces of the cut-out, and parallel to the row of cam followers there is a camshaft that has, for each of the cam followers, a cam or a sliding cam package acting on a respective one of the rollers and the camshaft is supported by an axial bearing relative to the cylinder head of the internal combustion engine, the method comprising:

a) providing the cam followers pre-sorted into two main groups, b) the two mounts of each of the cam followers of the first main group run relative to each other with offset with respect to a longitudinal extent of the cam follower in the side surfaces such that an axial line of the pin deviated from perpendicular in a clockwise direction, c) the two mounts of each of the cam followers of the second main group run relative to each other with offset with respect to the longitudinal extent of the cam follower in the side surfaces such that an axial line of the pin deviates from perpendicular in a counterclockwise direction, and d) for each row of the cam followers, selecting a sub-group from the first and second main groups and mounting the sub-groups of the cam followers to at least one of minimize or compensate for an axial thrust of the camshaft on the axial bearing.

2. The method according to claim 1, wherein each of the main groups is made from at least two sub-groups grouped with respect to the offsets thereof.

3. The method according to claim 1, further comprising: producing the mounts for the pins selectively with a corresponding offset with respect to the longitudinal extent of the cam followers.

4. The method according to claim 1, further comprising:

e) using cam followers of a completely identical batch for the row of cam followers of the valve train, f) from said batch, after the production of the identical cam followers, a first sub-group of cam followers whose said mounts in the side surfaces have the offset from the perpendicular in the clockwise direction caused by production tolerance, so that these are the cam followers of the main group and g) from said batch, after the production of the cam followers, measuring and selecting a second sub-group of cam followers whose said mounts in the side surfaces have the offset from the perpendicular in the counterclockwise direction caused by production tolerance, so that these are the cam followers of the main group.

5. The method according to claim 1, wherein each of the cylinders of the internal combustion engine has exactly two or a multiple of two identically acting ones of the gas exchange valves, h) for the variant with two identically acting ones of the gas exchange valves for each of the cylinders, loading one of the gas exchange valves by one of the cam followers from the first main group and another one of the gas exchange valves by one of the cam followers from the second main group, and i) for the variant with the multiple of two identically acting one of the gas exchange valves for each of the cylinders, a same number of the gas exchange valves are contacted by ones of the cam followers from the first and second main group.

6. The method according to claim 1, wherein a hydraulic or mechanical support element is provided as the pivot support for the cam follower.

7. A valve train of an internal combustion engine comprising a row of cam followers of which each said cam follower is supported on one side on a bottom side on one end by a pivot support relative to a cylinder head of the internal combustion engine and acts on the other end on at least one gas exchange valve and on the other side has at least in a middle section a cut-out in which a roller that runs on a pin sits, wherein said pin is supported in mounts of side surfaces of the cut-out, a camshaft runs parallel to the row of cam followers and the camshaft has for each of the cam followers a cam or a sliding cam package acting on the roller and the camshaft is supported by an axial bearing relative to the cylinder head of the internal combustion engine, the camshaft loads a row of cam followers that act on identically acting ones of the gas exchange valves for each of the cylinders of the internal combustion engine, wherein each of the cylinders has two of the identically acting ones of the gas exchange valves, and for at least one of minimizing or compensating for an axial thrust of the camshaft on the axial bearing, j) one of the gas exchange valves is loaded by one of the cam followers whose said mounts run relative to each other with an offset with respect to a longitudinal extent of the cam follower in the side surfaces such that an axial line of the pin deviates from perpendicular in a clockwise direction, and k) the other of the gas exchange valves is loaded by one of the cam followers whose said mounts run relative to each other with an offset with respect to the longitudinal extent of the cam follower in the side surfaces such that an axial line of the pin deviates from perpendicular in a counterclockwise direction, and l) the deviations from the perpendicular according to j) and k) are at least approximately equal in of magnitude.

* * * * *